United States Patent [19]

Oliver et al.

[11] Patent Number: 4,986,858

[45] Date of Patent: Jan. 22, 1991

[54] EMULSIFICATION METHOD

[75] Inventors: Raymond Oliver, Cleveland, England; Jeremy G. B. Smith; Fortunato Villamagna, both of Quebec, Canada

[73] Assignee: Imperial Chemical Industries PLC, London, England

[21] Appl. No.: 539,487

[22] Filed: Jun. 18, 1990

[30] Foreign Application Priority Data

Jun. 16, 1989 [GB] United Kingdom ..... 8913871
Jun. 23, 1989 [GB] United Kingdom ..... 8914507

[51] Int. Cl.[5] ..... C06G 45/00
[52] U.S. Cl. ..... 149/109.6; 149/2
[58] Field of Search ..... 149/109.6, 2

[56] References Cited

U.S. PATENT DOCUMENTS 4,273,147 6/1981 Olney ..... 149/108.8
4,461,660 7/1984 Binet et al. ..... 149/109.6
4,911,770 3/1990 Oliver et al. ..... 149/109.6

*Primary Examiner*—Stephen J. Lechert, Jr.
*Attorney, Agent, or Firm*—Cushman, Darby & Cushman

[57] ABSTRACT

A method for producing an emulsion explosive comprises introducing a liquid organic fuel phase and an immiscible liquid oxidizer phase into apparatus having a mixer chamber, flow constrictor means for introducing the liquid oxidizer phase as an emergent turbulent jet into the chamber to cause its fragmentation into droplets in situ within the chamber, means for introducing the fuel phase into the chamber so that the fuel phase introduced thereby contacts and becomes distributed around the droplets of oxidizer phase as they form to produce emulsion and further providing shear mixing means within the mixing chamber to effect enhancement of the mixing of the chamber contents and thereby to continuously incorporate the fuel phase to produce a more refined emulsion suitable for use as the basis for an explosive system, particularly emulsions of high velocity.

13 Claims, 2 Drawing Sheets

Figure 1:
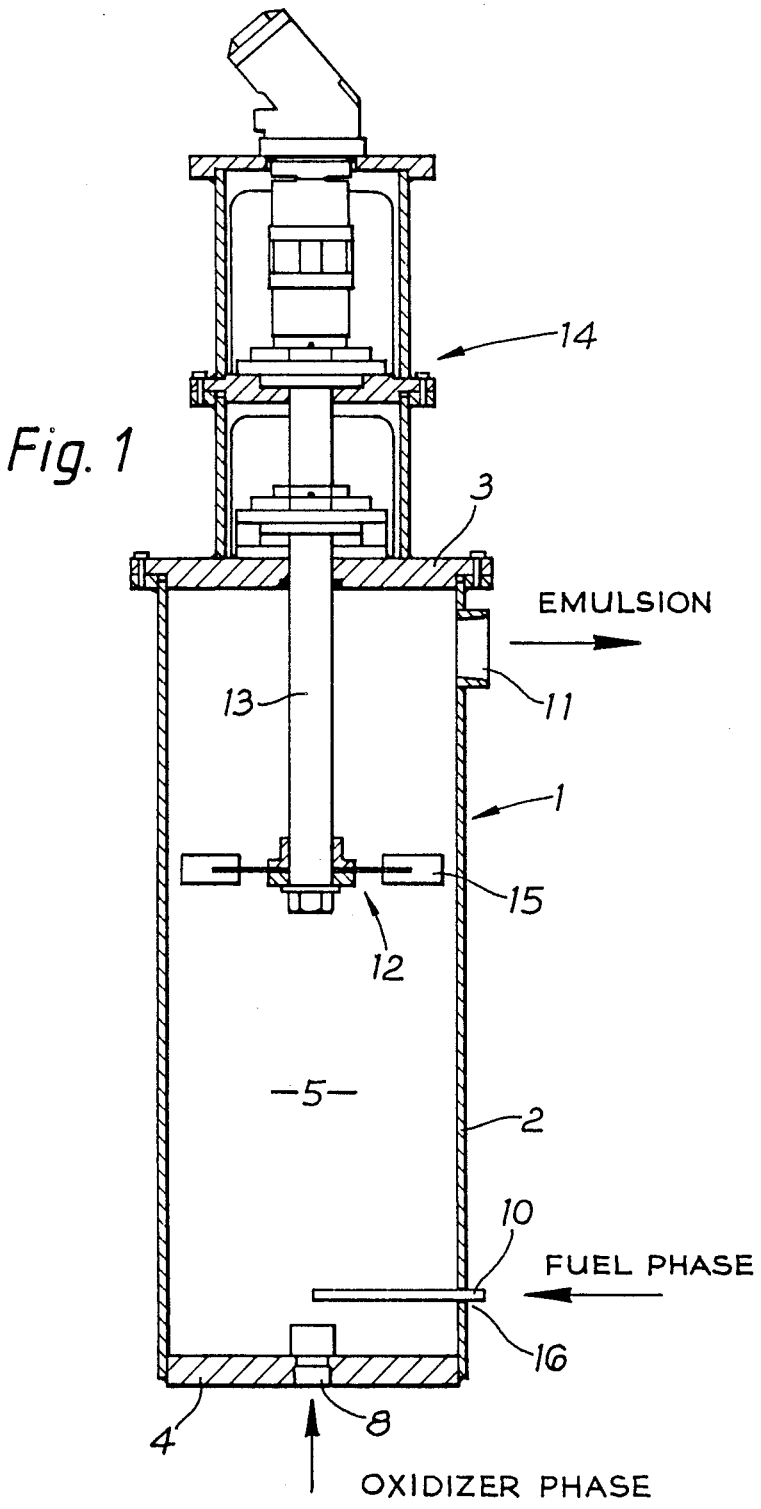

14
3
EMULSION
11
13
1
15
12
-5-
2
10
FUEL PHASE
16
4
8
OXIDIZER PHASE

EMULSIFICATION METHOD

The present invention relates to the formation of water-in-oil emulsions of high internal phase volume, and in particular to improvements in or relating to a method using apparatus for the continuous manufacture of emulsions which are useful as the basis of an explosive system.

Our co-pending applications GB No. 8826092, AU No. 25953/88, BR No. PI8806666, CA No. 584952, EP No. 88310493.7, NO No. 885593, U.S. No. 284893, and ZA No. 88/8740 disclose a method and apparatus for the continuous manufacture of oil/water emulsion explosives from a liquid organic fuel medium and an immiscible liquid oxidiser. The apparatus disclosed therein comprises a mixing chamber, flow constrictor means for introducing the liquid oxidiser as an emergent turbulent jet into the chamber, and in so doing, causing the formation of droplets of the oxidiser in situ within the chamber. The constrictor means is conveniently provided in the form of a spray nozzle as is commonly used in the spray drying art.

The apparatus further provides means for introducing the fuel medium into the chamber so that the fuel introduced thereby contacts and stabilises the droplets of oxidiser solution as they are formed, so as to maintain discrete droplets of oxidiser liquid, thereby providing an emulsion suitable for use as the basis for an explosive system.

The fuel inlet tube is preferably mounted in the side wall of the cylindrical vessel in a readily adjustable manner (axially and radially) and aligned along a radial direction of the cylindrical vessel.

The emulsion formed is extracted via an outlet port located in the wall of the mixing chamber at or near the upper end of the cylindrical vessel.

It has been found, however, that when attempting to produce emulsions of high viscosity the basic apparatus disclosed in the referenced prior applications may produce emulsions of less than the desired quality. The high viscosity of emulsions is a function of the nature of the chosen formulation and the desired droplet size.

Further, the purpose of forming the described emergent jet is twofold, firstly to produce small droplets of the liquid oxidiser and secondly, to mix the oxidiser and oil phases via the vortex created. However, if insufficient fuel phase is present to envelop and keep apart the initially formed small droplets (resulting from spontaneous fragmentation of the emergent turbulent jet) product inhomogeneity results. Part of the oxidiser phase forms a very viscous emulsion with available oil phase, and part is unable to achieve emulsification through oil-phase starvation and its droplets re-coalesce to form domains of liquid oxidiser phase.

It is an object of this invention to improve upon the apparatus and methods of our application cited above and thereby obviate or mitigate the aforesaid difficulties.

It is therefore an object of the present invention to provide a method using apparatus for the formation of oil/water emulsions which can be used as a basis for explosive systems.

It is a further object of this invention to provide a method using apparatus which safely manufactures oil/water emulsion on a continuous basis, particularly emulsions having high viscosity, e.g. low oil content emulsions.

Accordingly, the invention provides a method for the continuous production of an oil/water emulsion explosive composition, which method comprises simultaneously and continuously introducing into a mixing chamber separate liquid streams of a continuous phase component and an immiscible discontinuous phase component, the immiscible discontinuous phase component, the immiscible discontinuous phase component being introduced into the continuous phase through turbulence inducing means which constricts the flow of the immiscible discontinuous phase such as to cause its spontaneous disruption to form fine droplets of a desired size upon its emergence into the mixing chamber, the turbulence inducing means further causing the immiscible discontinuous phase to emerge in a flow pattern and at a flow rate sufficient to cause the droplets so formed to entrain the continuous phase component to provide for mixing thereof with the droplets to form emulsion, wherein shear mixing means downstream of the turbulence inducing means for further mixing of the emulsion, and thereby continuously form a more refined or homogeneous emulsion suitable for use as the basis for an explosive system.

The shear mixing is conveniently carried out within the mixing chamber in a central region thereof.

The shear mixing means is conveniently positioned centrally in the path of emulsion forming within the mixing chamber.

The shear mixing means may comprise one or more rotating members adapted to cause fluid shearing which may, for example, be selected from an impeller, paddle, propeller or turbine mixer or like mixer.

Preferably an impeller which has no net axial pumping action in used. Its distance downstream of the flow constrictor means, e.g. jet nozzle, will be optimised to ensure good continuous incorporation of oil phase by its mixing action.

Preferably, the mixing chamber is defined by a cylindrical vessel having end closures. The first (normally the lower in use) such end closure is preferably provided with means for introducing the oxidiser.

Preferably also, the central axis of rotation of the shear mixing means is substantially co-axial with the central axis of the cylindrical vessel.

Conveniently, the shear mixing means is driven by a shaft penetrating the opposite end closure.

The method of this invention can be applied to manufacture a wide range of formulations suitable for use as the basis for an explosive system. A typical formulation will be made up of sodium and ammonium nitrate solutions with suitable emulsifiers and modifiers (if required) in a fuel such as paraffin oil. The emulsifiers may be any of the usual types known in this art, e.g. sorbitan esters and preferably are polymeric emulsifiers, e.g. PIBSA derivations. Thus the emulsifier may be one or more of: Sorbitan esters such as the mono- and sesqui oleates; fatty acid salts, amides and mono- or di- glycerides; substituted oxazolines and phosphate esters thereof (for example, 2-oleyl-4,4'-bis (hydroxy methyl) -2-oxazoline); polymeric emulsifiers as described in U.S. Pat. No. 4357184; and polymeric emulsifiers as disclosed in European Pat. No. 0155800, and broadly composed of a polyalk(en)yl chain of say 500 to 1500 molecular weight (Mn) joined to a small head group which is hydrophilic (e.g. amine or ethanolamine) directly or through a suitable link group, e.g. through a succinic acid moiety or a phenolic link as described in U.S. Pat. No. 4784706. Usual additives such as additional fuel components and usual sensitisers will be added to produce the final explosive emulsion formulation.

Figure 2:
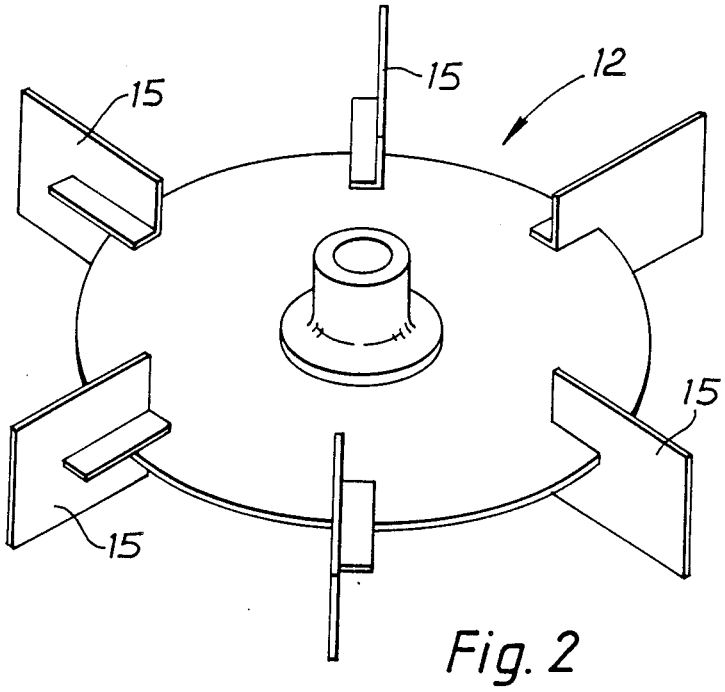
Figure 3:
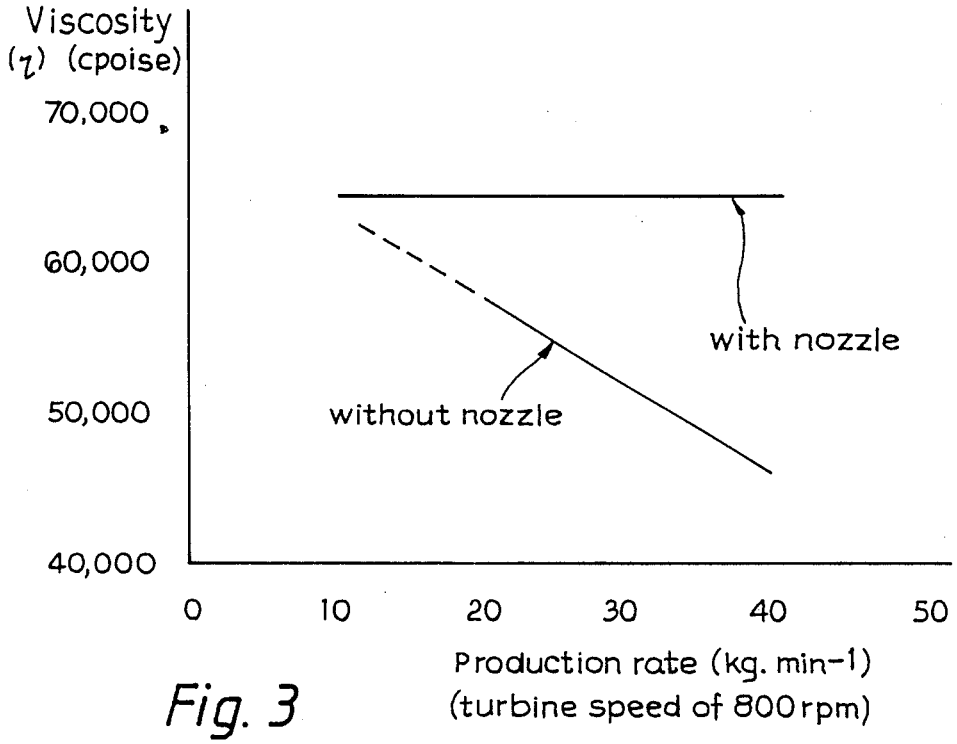

The invention will now be described, by way of example only, with reference to the accompanying drawings in which:

FIG. 1 - is a cross-sectional view of an embodiment of the emulsification apparatus of the invention;

FIG. 2 - is a perspective view from above of an impeller which may be used in the invention; and FIG. 3 - is a graph illustrating the effect of a nozzle on emulsion viscosity with varying production rate.

Referring now to the drawings, an emulsification apparatus 1 consists of a cylindrical tube 2, having an upper end closure 3 and lower end closure 4. When assembled as shown, tube 2 and closures 3 and 4 define a chamber 5. Centrally located in lower end closure 4 is an atomising inlet 8. Mounted in the side wall of chamber 5 and passing through tube 2, near the lower end of the tube 2 is a fuel inlet 16.

Further provided is a fuel inlet nozzle 10 which enters the mixing chamber 5 via the fuel inlet 16. The inlet nozzle 10 may be aligned along a radial direction of tube 2, and may be adjustable both laterally (i.e. at right angles to the longitudinal axis of the tube 2) and longitudinally (i.e. along the length of the tube 2).

Located in the side wall of chamber 5 and passing through tube 2 near the upper end of tube 2, is an exit or outlet port 11. Located within the chamber 5 is an impeller 12, the central axis of rotation of the impeller 12 being substantially coaxial with the central axis of the tube 2. The drive shaft 13 of the impeller 12 enters the chamber 5 via the upper end closure 3, the driving mechanism 14 of the drive shaft 13 being located externally to the chamber 5.

The emulsification apparatus of FIG. 1 may have the following dimensions: the cylindrical tube 2 may be 20–30" (0.5080–0.7620 m) long, and have an internal diameter of, say, 10" (0.2540 m), in which case the impeller 12 may have a diameter of 9–9.5" (0.2286–0.2413 m) and consist of six to eight 1" (0.0254 m) blades uniformly arranged as shown schematically in FIG. 2. The clearance between the outer edge of the impeller blades 15 and the inner surface of the cylindrical tube 2 will in this configuration be 0.25"–0.5" (0.0064 m–0.0127 m). The distance of the impeller from the nozzle 10 is suitably about 11" (0.2794 m).

Emulsification apparatus 1 is adapted to deliver a turbulent spray or stream of droplets of a discontinuous phase component into a body of a continuous phase component with sufficient velocity to effect emulsification. The continuous phase component, i.e. the fuel is continuously introduced into chamber 5 through inlet nozzle 10 where it is entrained by a high velocity atomized stream or spray of the discontinuous phase component, i.e. the oxidiser is introduced continuously into chamber 5 through inlet 8. The intermixing of the two phases forms an emulsion which may comprise particles of a size as small as 2 microns or less.

However, applicants have found that in some instances, usually when emulsions of high viscosity are first formed in the chamber, the mixing action of the jet alone may be inadequate to produce the desired continuous entrainment of fuel phase into the forming emulsion mixture. Shear mixing means, such as an impeller 12, may therefore be used to facilitate the mixing and assure good refinement and emulsion homogeneity.

As the emulsion flows past the impeller it may be further refined by shearing action, as a secondary effect of the impeller arrangements in the chamber.

It has been found that, for a given impeller speed, the product viscosity increases and oxidiser droplet size decreases when a suitable nozzle is utilised at inlet pressures of 80–100 psi.

Shown in FIG. 3 is a graph of emulsion viscosity (centipoise) versus production rate (kg $min^{-1}$) for an impeller speed of 800 rpm, for the situation where a typical paraffinic fuel phase was introduced into the mixing chamber 5 through the fuel inlet 16 with the nozzle 10 at a rate of around 4.5–5.0 parts $min^{-1}$ and typical AN oxidiser phase was introduced into the chamber 5 through inlet 8 at a rate of around 95 parts $min^{-1}$. The emulsion viscosity was measured using a Brookfield Viscometer (spindle 7 at 50 rpm, at a temperature of 90°).

As can be seen from FIG. 3 as the production rate is increased the viscosity of the final emulsion product remains substantially the same over a wide range of production rates. This was not the case when the impeller was removed and inlet 8 alone used.

The emulsification method and apparatus disclosed herein offers a self compensating mixer allowing a range of product flow-rates. At high product flow rates the jet type mixer does most of the mixing work, due to the high inlet pressures of the fuel and the oxidiser phases. At lower flow rates however, the impeller will do a significant part of the mixing work, since the fuel and oxidiser phases are introduced into the mixing chamber at lower inlet pressures, the emulsion so formed having a higher residence time within the mixing chamber.

We claim:

1. A method for the continuous production of an oil/water emulsion explosive composition, comprising simultaneously and continuously introducing into a mixing chamber separate liquid streams of a continuous phase component and a immiscible discontinuous phase component, the immiscible discontinuous phase component being introduced into the continuous phase through turbulence inducing means which constricts the flow of the immiscible discontinuous phase such as to cause its spontaneous disruption to form fine droplets of a desired size upon its emergence into the mixing chamber, the turbulence inducing means further causing the immiscible discontinuous phase to emerge in a flow pattern and at a flow rate sufficient to cause the droplets so formed to entrain the continuous phase component to provide for mixing thereof with the droplets to form an emulsion, wherein shear mixing means is provided downstream of the turbulence inducing means for further mixing of the emulsion, and thereby continuously form a more refined or homogeneous emulsion suitable for use as the basis for an explosive system.

2. A method according to claim 1, wherein the shear mixing means comprises at least one rotatable member selected from the group consisting of an impeller, paddle, propeller, and a turbine.

3. A method according to claim 2, wherein the shear mixing means comprises an impeller which has no net axial pumping action.

4. A method according to claim 2, wherein the mixing chamber is defined by a cylindrical vessel having end closures wherein one of said end closures has means for introducing the oxidiser, further providing an adjustably mounted fuel inlet tube located in the side wall of the cylindrical vessel and aligned along a radial direction of the cylindrical vessel, and an outlet port for the extraction of formed emulsion located in the side wall of the mixing chamber at or near the other end of the cylindrical vessel.

5. A method according to claim 4, wherein the central axis of rotation of the shear mixing means is substantially co-axial with the central axis of the cylindrical vessel.

6. A method according to claim 4, wherein the shear mixing means is driven by a shaft penetrating an end closure of the mixing chamber.

7. A method according to claim 5, wherein the shear mixing means is driven by a shaft penetrating an end closure of the mixing chamber.

8. A method according to any one of claims 2 to 7 wherein the shear mixing means comprises a single disc rotatable upon a shaft and having peripheral vanes extending out of the plane of the disc in axial planes.

9. A method according to claim 3, wherein the mixing chamber is defined by a cylindrical vessel having end closures wherein one of said end closures has means for introducing the oxidiser, further providing an adjustably mounted fuel inlet tube located in the side wall of the cylindrical vessel and aligned along a radial direction of the cylindrical vessel, and an outlet port for the extraction of formed emulsion located in the side wall of the mixing chamber at or near the other end of the cylindrical vessel.

10. A method according to claim 9, wherein the central axis of rotation of the shear mixing means is substantially co-axial with the central axis of the cylindrical vessel.

11. A method according to claim 9, wherein the shear mixing means is driven by a shaft penetrating an end closure of the mixing chamber.

12. A method according to claim 10, wherein the shear mixing means is driven by a shaft penetrating an end closure of the mixing chamber.

13. A method according to any of claims 9 to 12 wherein the shear mixing means comprises a single disc rotatable upon a shaft and having peripheral vanes extending out of the plane of the disc in axial planes.

* * * * *